US005630450A

United States Patent [19]

Kurmis et al.

[11] Patent Number: 5,630,450

[45] Date of Patent: May 20, 1997

[54] TOOL FOR TENSIONING A BAND

[75] Inventors: Viktor Kurmis, Pinneberg; Hans-Dieter Thieme, Uetersen, both of Germany

[73] Assignee: Paul Hellermann GmbH, Pinneberg, Germany

[21] Appl. No.: 621,106

[22] Filed: Mar. 22, 1996

[30] Foreign Application Priority Data

Mar. 23, 1995 [DE] Germany ..... 295 04 940.5

[51] Int. Cl.[6] ..... B21F 9/00

[52] U.S. Cl. ..... 140/123.6; 140/93.2

[58] Field of Search ..... 140/93 A, 93.2, 140/93.4, 123.6

[56] References Cited

U.S. PATENT DOCUMENTS

| | | | |
|---|---|---|---|
| 3,254,680 | 6/1966 | Caveney et al. | 140/123.6 |
| 3,508,740 | 4/1970 | Palmer | 254/51 |
| 3,863,684 | 2/1975 | Simmons | 140/93.4 |
| 3,865,156 | 2/1975 | Moody et al. | 140/123.6 |
| 4,192,358 | 3/1980 | Bone | 140/123.6 |

FOREIGN PATENT DOCUMENTS

| | | | |
|---|---|---|---|
| 0035367A1 | 9/1981 | European Pat. Off. | E65B 13/02 |
| 2542388A1 | 9/1984 | France | F15B 11/20 |
| 896398 | 5/1962 | United Kingdom . | |

*Primary Examiner*—Lowell A. Larson
*Attorney, Agent, or Firm*—Chilton, Alix & Van Kirk

[57] ABSTRACT

A tool for tensioning a band and for actuating a band fastening and/or for cutting off the band at the end of the tensioning operation has a pressure-medium operated tensioning drive, a pressure-medium operated actuating drive and a valve arrangement which, when a predetermined pressure is attained at the tensioning drive, liberates the supply of pressure medium to the actuating drive. An accurately reproducible band tension is achieved by virtue of the fact that the valve arrangement comprises a reducing valve, which is connected to the tensioning drive by a pressure-medium supply line and can be set to the reducing pressure corresponding to the desired band tension. The pressure-medium supply line contains a restrictor. The valve arrangement comprises a pressure-medium actuated reversing valve, which is connected to the actuating drive and which is pressurized, with the aim of liberating the pressure-medium supply to the actuating drive, by the pressure obtaining at the tensioning drive as well as by a spring. With the opposite aim, it is pressurized by the pressure present in front of the restrictor in the pressure-medium supply line.

2 Claims, 2 Drawing Sheets

TOOL FOR TENSIONING A BAND

Figure 1:
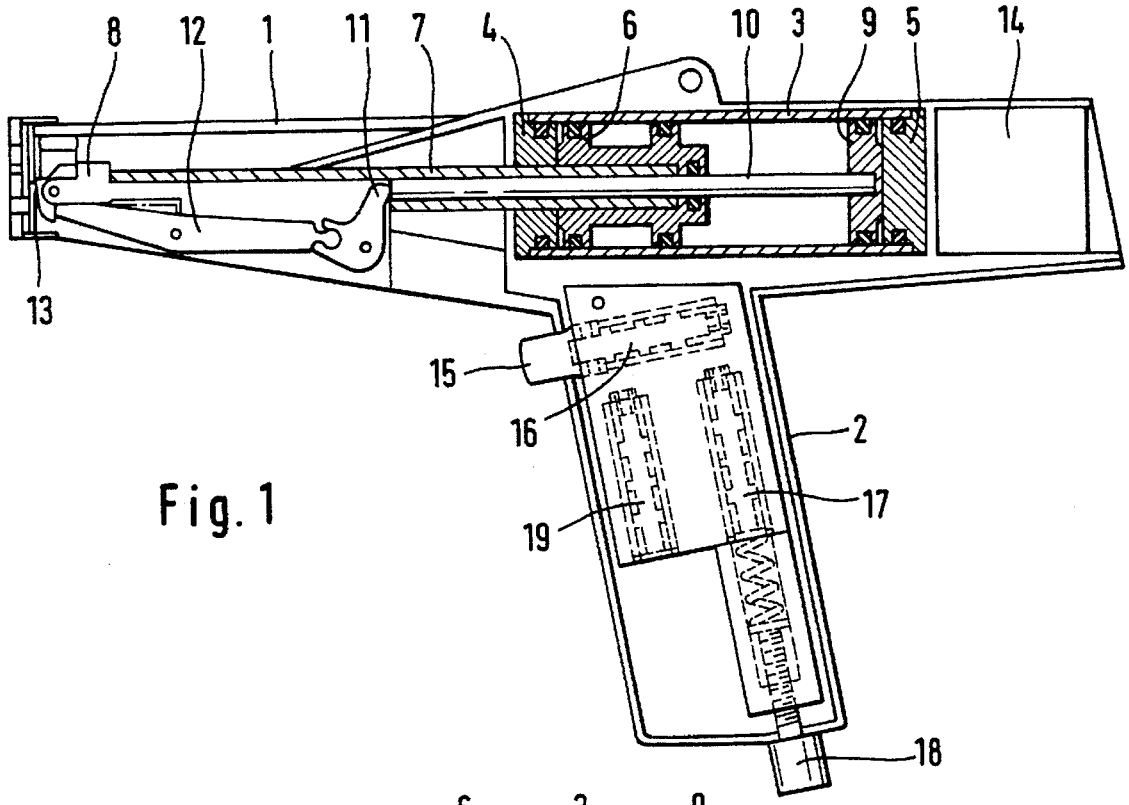

The invention relates to a tool for tensioning a band and for actuating a band fastening and/or for cutting off the band at the end of the tensioning operation, which tool has a pressure-medium operated tensioning drive, a pressure-medium operated actuating drive and a valve arrangement which, when a predetermined pressure is attained at the tensioning drive, liberates the supply of pressure medium to the actuating drive.

In a known apparatus of this type (FR-A 2542388), two piston, cylinder drives are provided, which are designed, on the one hand, to tension the band and, on the other hand, to actuate the band fastening and to which the pressure medium is fed by means of a reversing valve. In a first work phase, the pressure medium is supplied only to the tensioning drive; once a predetermined pressure is attained at the tensioning drive, the valve reverses and the pressure medium consequently makes its to the actuating drive. Meanwhile, the pressure in the tensioning drive is maintained. It is not known hat influence the pressure operating at the tensioning drive has upon the reversing valve, nor the accuracy with which a tensioning force which has once been set is able to be reproduced in repeated tensioning operations. It has to be assumed that the accuracy leaves just as much to be desired as in the case of another tool (EP-A 35367), in which the pressure which obtains at the tensioning/piston cylinder drive acts simultaneously upon the cutting drive.

The object of the invention is to increase the repeating accuracy. This applies particularly to small band tensions of the order of magnitude of a few DecaNewtons, as are required, for example, in medical technology. This is intended to be achieved in combination with a shortest possible cycle time.

The solution according to the invention consists in the valve arrangement firstly comprising a reducing valve, which is connected to the tensioning drive by a pressure-medium supply line and can be set to the reducing pressure corresponding to the desired band tension, a restrictor being housed within the pressure-medium supply line. Secondly, the valve arrangement comprises a pressure-medium actuated reversing valve, which is connected to the actuating drive. This is pressurized, on the one hand, with the aim of liberating the pressure-medium supply to the actuating drive, by the pressure obtaining at the tensioning drive as well as by a spring and, on the other hand, with the opposite aim, by the pressure present in front of the restrictor in the pressure-medium supply line.

The tensioning drive is adjusted by adjustment of the reducing valve. The effect of this, in conjunction with the restrictor arrangement, is that the pressure at the tensioning drive develops at first rapidly and then, as the end pressure is increasingly approached, slowly. The pressure measurement which is made for the actuation of the reversing valve takes place in the final, less steep region of the pressure increase, thereby promoting accuracy, to be precise Just as much at low as at high band-tension settings. The steep pressure increase in the first part has the effect, on the other hand, of speeding up the operation.

Irrespective of the band tension which has been set, it is thereby possible to achieve both a short cycle time and good preconditions for accurately establishing that pressure level at which reversal is intended to occur.

A surprising development, moreover, is that the actuation of the reversing valve is not based upon the measurement of the pressure to be attained corresponding to the band tension to be attained, but upon the measurement of the differential pressure in the pressure-medium supply line to the tensioning drive. As long as the band tension and hence the pressure at the tensioning drive is low, the restrictor in the supply line to the tensioning drive is rapidly flowed through and a relatively large pressure difference is created. This pressure difference causes the reversing valve to be held in the shut-off position. At the end of the tensioning operation, on the other hand, the pressure-medium flow declines. The pressure differential consequently falls until it eventually is no longer sufficient to counterbalance the spring operating in the direction of liberation and the supply of pressure medium to the actuating drive is duly liberated.

Although it is stated above and in the claim that the reducing valve can be set to that pressure which corresponds to the band tension to be attained, this is only therefore approximately true. Strictly speaking, the actuating drive is liberated whenever a difference is attained between the pressures in the supply line to the tensioning drive in front of and behind the restrictor, which difference is predefined by the design of the reversing valve and the force of its spring. This is taken as a sign that the pressure which is set at the reducing valve has virtually been attained at the tensioning drive. Any deviation of the pressure actually present at the tensioning drive from the reducing pressure which is set has no adverse effect upon the repeating accuracy of the band tension which is set, since it is the same in each tensioning operation. It has been shown that, with the appliance according to the invention, a very high repeating accuracy is possible. In the case of an appliance which had a range of setting of the band tension from 40 to 260N, the deviations were less than 2N. This repeating accuracy is better, by some orders of magnitude, than that attainable with previously known mechanically or pneumatically operated tools.

For control purposes, the appliance can be equipped with an independently working device for measuring the tensioning pressure and for indicating the band tension which is thereby obtained.

Figure 2:
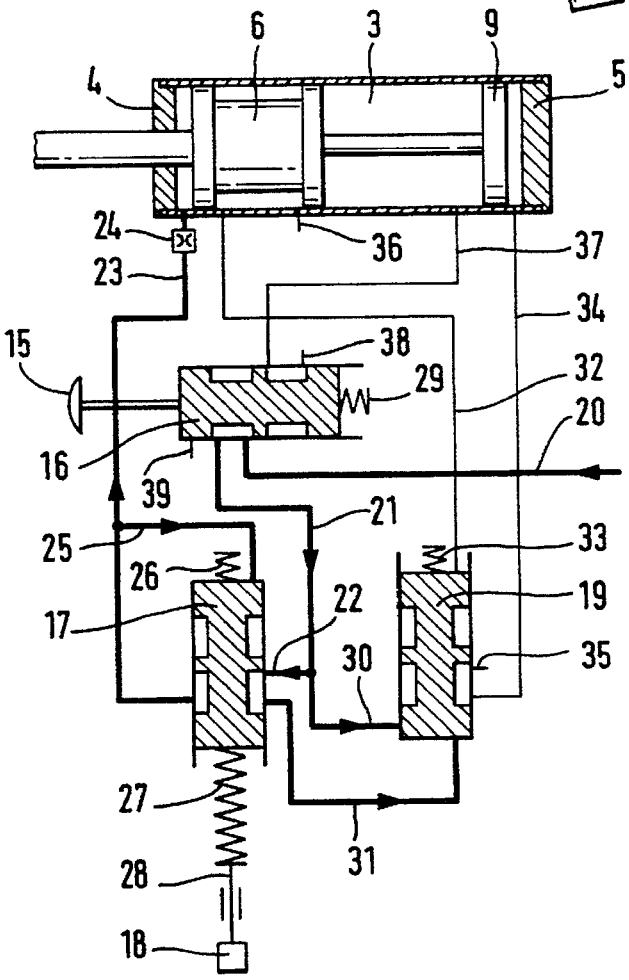
Figure 4:
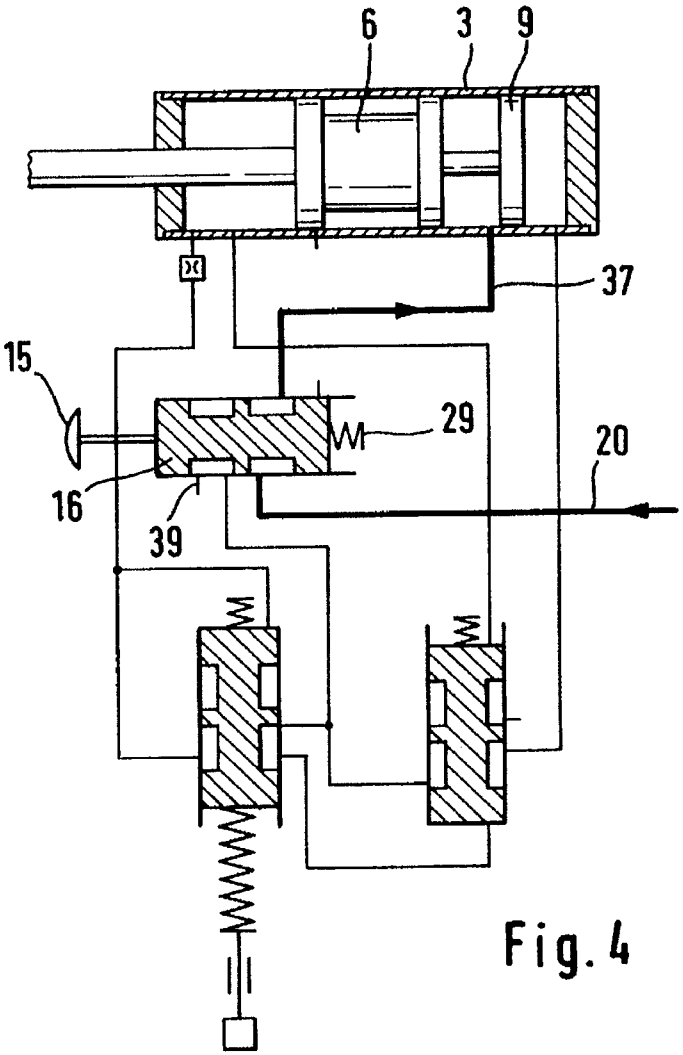
Figure 3:
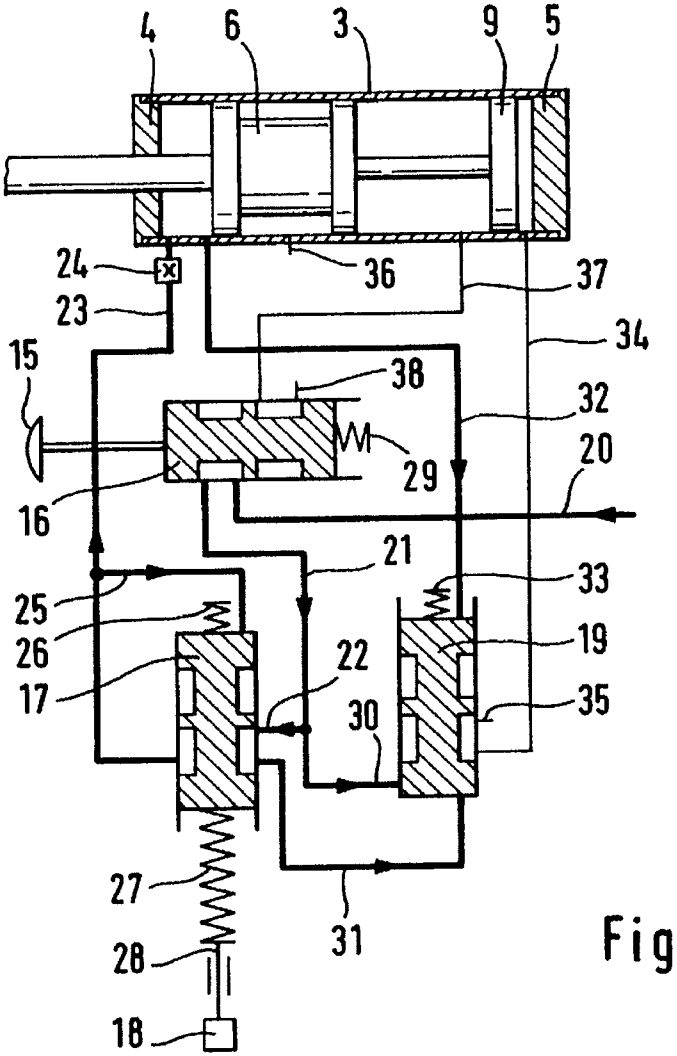

The invention is explained in greater detail below with reference to the drawing, which illustrates an advantageous illustrative embodiment and in which:

FIG. 1 shows a diagrammatic longitudinal section through the entire tool, and FIGS. 2–4 show the circuit diagram of the drive arrangement in different function settings.

The housing of the tool forms an elongated tool body 1 and a handle 2 which is attached thereto in the style of a pistol. The tool body contains a pneumatic cylinder 3, which is sealed off at the ends by a front plate 4 and a rear plate 5. It contains a first piston 6, which is connected by a piston rod 7 to a collet chuck 8 for gripping the end of a band to be tensioned. The piston rod 7 is guided in seal-tight arrangement through the plate 4. The said tool body further contains a second piston 9 having a piston rod 10, which is guided in seal-tight arrangement through the hollow-configured piston rod 7 and the front end of which acts upon a pair of levers 11, 12, which levers act at the front end upon a cutting blade 13. The arrangement and working method of the collet chuck 8 and cutting blade 13 require no further elucidation, since they are known. In order to tension the band, pressure medium is introduced into the cylinder 3 between the front plate 4 and the piston 6. The latter is consequently moved to the right in the drawing, together with the piston rod 7 and collet chuck 8. If the motional path available to the piston 6 is less than the band length to be tensioned, then this operation is repeated over again. The return of the piston 6 to the original position represented in FIG. 1 is effected by the supply of pressure medium on the rear side of the said piston. Once the desired band tension is attained, pressure medium is introduced between the rear end plate 5 of the cylinder 3 and the second piston 9, whereby the latter is moved with the piston rod 10 to the left (in the drawing), so that the pair of levers 11, 12 is moved such that the blade 13 causes the protruding, tensioned band end to be cut off. The piston 9 is returned to its original position likewise by pressure medium, which is fed into the cylinder 3 between the pistons 6 and 9.

At the rear end of the tool body 1 there is a space 14, in which there is disposed a device (not shown in greater detail) for measuring the pressure present in the cylinder 3 between the plate 4 and the cylinder 6. In that end of the space 14 which is open towards the rear there is an indicator display, which indicates the measurement result in the form of the band tension which is obtained by this pressure.

In the handle 2 there is the valve arrangement by which the pressure-medium supply to the cylinder 3 is controlled. The work cycle is started up by a starter button 15, which acts upon a starting valve 16. The reducing pressure of the reducing valve 17 can be set by means of a setting screw 18. The reversing valve is provided at 19. At a location (not shown) there is disposed a connecting device for a flexible compressed-air line. A standard industrial pressure of, for example, 6 bar can be used.

In the circuit diagrams of FIGS. 2 to 4, it can be seen that the compressed-air supply line 20 is connected to the starting valve 16. The slide of the starting valve 16 can be displaced against spring force 29, by pressure upon the button 15, into the position shown in FIG. 2, in which the feed line 20 is connected to the line 21. If the button 15 is released, then the slide makes its way into the position shown in FIG. 4, in which the line 21 is separated from the feed line 20 and is connected to an air vent 39, whilst the feed line is connected to a line 37 leading to the cylinder 3, to be precise to a location which remains situated between the two pistons 6 and 9 even when both have fully completed their working stroke. If the button 15 is depressed and the slide of the starting valve 16 is in the start-up position (FIG. 2), then this line 37 is deventilated via the opening 38 in the starting valve 16.

From the starting valve 16, a line 21 leads via a branch connection 22 to the reducing valve 17. The reduced pressure is supplied via the pressure-medium supply line 23 to the cylinder 3, to be precise between the front end plate 4 and the piston 6 in its original position. A restrictor 24 is provided in the pressure-medium supply line 23, to be precise preferably close to the cylinder 3. The restrictor can be simply constructed, in that the inlet bore is made in the cylinder wall 3 with a clear diameter which is smaller than that of the pressure-medium supply line 23. The latter, for example, (like all other lines specified in the arrangement) has a clear diameter of 2 to 3 mm, whilst the restrictor bore 24 has a diameter of 0.6 mm.

From the pressure-medium supply line 23, a branch line 25 leads to the end side of the slide of the reducing valve 17. Moreover, this side of the slide is pressurized by a spring 26, which is generally set to a non-variable value. This spring 26 and the pressure operating. in the line 25 are intent on displacing the slide of the reducing valve 17 in the downward direction in the drawing, so that the guiding edge of the slide, which guiding edge interacts with the inlet bore of the branch line 22, endeavours to close the said branch line.

The opposite end side of the slide of the reducing valve 17 is acted upon by a spring 27, the spring force of which can be adjusted by means of a screw spindle 28 with hob 18. In the original position of the reducing valve 17, the inlet opening of the branch line 22 is open. During running, the slide of the reducing valve 17 adjusts itself such that the reduced pressure which acts upon the slide via the line 25 is counterbalanced, on the one hand, by the spring 26 and, on the other hand, by the force of the spring 27. If the reduced pressure declines, then the guiding edge of the slide slightly opens the inlet opening of the branch line 22, so that more compressed air makes its way into the pressure-medium supply line 23. If the reduced pressure deviates upwards from the target value, then the inlet opening of the branch line 22 is closed to a correspondingly greater degree. The springs 26 and 27 are dimensioned such that the desired range of setting of the reduced pressure is obtained.

The line 21, which in the start-up state of the starting valve 16 is connected to the feed pressure, is connected by the branch line 30 to the reversing valve 19. In addition, the reversing valve 19 is connected by the line 31 frontally to a region of the reducing valve 17 which constantly contains the reduced pressure. The reduced pressure consequently acts upon that end side of the slide of the reversing valve 19 which appears at the bottom in the drawing. The other end side of the slide of the reversing valve 19 is connected by a line 32 to the cylinder 3, to be precise at a location on the said cylinder which lies close to the mouth of the pressure-medium supply line 23 but, in the original state of the piston 6, is shut off from the peripheral surface of the latter, so that the pressure supplied to the cylinder by the pressure-medium supply line 23 at the beginning of the work cycle cannot yet immediately be communicated to the line 32. It is only after a small displacement of the piston 6 to the right that the pressure which acts in the cylinder 3 upon the left side of the piston 6 is communicated via the line 32 to the upper end side of the slide in the reversing valve 19, so that it opposes the reduced pressure acting via the line 31 upon the lower end face. Moreover, the upper end face of the slide of the reversing valve 19 is acted upon by a spring 33, whose force acting upon the slide is generally set to a specific, non-variable value. The reversing valve 19 is finally connected by a line 34 to the cylinder 3, to be precise at a location which, in the original position of the second piston 9, lies between this and the rear end plate 5 of the cylinder.

The slide of the reversing valve 19 can assume a first position (represented in FIG. 2), in which the lines 30 and 34 are not interconnected and hence the feed pressure does not act via the line 34 upon the cylinder 3. It is moved into this position by the pressure which acts via the line 3i upon the lower side of the slide. 0n the other hand, the spring 33 and the pressure acting via the line 32 upon the top side of the slide are intent on moving the slide into a position in which the lines 30 and 34 are interconnected. Once the upper and lower end faces of the slide of the reversing valve 19 are equal in size, the slide is therefore pressurized by the difference in pressures operating in the line 31 and line 32, as well as by the spring 33. The reversing valve 19 also has an air vent 35, which is connected to the line 34 whenever the latter is not connected to the line 30.

The cylinder 3 has an air vent 36 at a location which, in the original state and during the stroke of the piston 6, is shut off by the latter and is liberated once it has completed the maximum stroke.

The functioning of this circuitry is explained below with reference to the different function stages represented in FIGS. 2 to 4. In these figures, those lines which respectively carry compressed air are thickly drawn.

FIG. 2 shows the circuitry directly after the button 15 of the starting valve 16 has been pressed. The feed pressure 20 acts via a line 21, 22 upon the reducing valve 17. The reduced pressure acts via the pressure-medium supply line 23 upon that side of the piston 6 which is represented on the left in the drawing and via the line 31 upon the lower end side of the slide of the reversing valve 19. The upper end side of this slide is not yet pressurized by the reduced pressure, since the mouth of the line 32 into the cylinder 3 is still shut off by the piston 6. The pressure which acts upon the lower end side of the slide of the reversing valve 19 moves the slide upward counter to the spring 33, whereby the line 30 carrying the feed pressure is shut off from the line 34 to the cylinder 3. Via the line 25, the reduced pressure also acts upon the upper end side of the slide of the reducing valve 17, as is necessary for the reducing function of the latter.

As soon as the piston 6 has set itself in motion, the inlet opening of the line 32 in the cylinder 3 becomes free and the pressure operating in the cylinder is transmitted—as indicated in FIG. 3—via the line 32 to the upper end side of the slide of the reversing valve 19. Thanks to the action of the restrictor 24, this pressure is less than the reduced pressure acting via the line 31 upon the opposite end side of the slide of the reversing valve 19. The force differential, which acts upon the slide as a result of these two pressures is also less than the force of the spring 33. For this reason, the reversing valve remains in the shut-off position.

Once the piston 6 has completed its working stroke determined by the positioning of the air vent 36, without the band having been sufficiently tensioned, the tensioning operation ends, since the deventilation of the cylinder 3 brings an end to the pressure of the pressure medium upon the piston 6. The user of the tool releases the button 15. Consequently, the piston 6 is returned to its original position—as is described later. The user begins a new work cycle by re-pressing the button 15. The pressure which operates in the cylinder 3 to the left of the piston 6 corresponds at all times to that force which the band to be tensioned exerts upon the piston counter to the motional direction of the latter. This force increases as the tensioning operation progresses; the pressure in the cylinder 3 also rises accordingly. As a consequence of this, the speed at which the pressure medium flows to the cylinder and hence also the pressure differential acting upon the restrictor 24 fall. A corresponding reduction is also obtained in the force differential which is exerted upon the slide of the reversing valve 19 by those pressures which are exerted via the lines 31 and 32 upon its opposite end faces. If this force differential becomes less than the force exerted by the spring 33, then the slide is displaced until it opens the reversing valve and consequently the feed pressure is communicated via the line 34 to the interspace in the cylinder 3 between the piston 9 and the rear end plate 5. The piston 9 is displaced to the left, thereby actuating the cutting apparatus.

The user will now let go of the button 15, since the work cycle is ended. The circuitry consequently enters into the state according to FIG. 4, in which the space between the pistons 6 and 9 is pressurized by the feed pressure via the line 37, whereby the pistons are returned to their original position. The space between the piston 6 and end plate 4 is thereupon deventilated via the lines 23, 22, 21 and the space between the piston 9 and end plate 5 via the lines 34, 30, 21.

The cycle can now begin afresh.

In order to indicate the tensioning force, the pressure in the cylinder 3 has to be measured at that moment at which the tensioning operation is ended. Expediently, a short, predetermined time span is provided for the measuring procedure after the cutting operation has been activated, within which time span the highest measured pressure is established as determinant, stored. to memory and displayed. For this purpose, the lever 11 or 12 can be fitted with a microswitch, which defines the start of the measuring time span. The length of this time span is set such that any pressure increase which might still be occurring after the tensioning operation is ended is no longer registered. The pressure-measuring sensor can be connected to the line 32.

We claim:

1. In a tool for tensioning a band and for actuating a band fastening and/or for cutting off the band at the end of the tensioning operation, having a pressure-medium operated tensioning drive (3, 6), a pressure-medium operated actuating drive (3, 9) and a valve arrangement (17, 19) which, when a predetermined pressure is attained at the tensioning drive (3, 6), liberates the supply of pressure medium to the actuating drive (3, 9), the combination wherein the valve arrangement comprises a reducing valve (17), which can be set to reducing pressure corresponding to the desired band tension, a pressure-medium supply line (23) connected to the tensioning drive (3, 6), a restrictor (24) housed within the pressure-medium supply line (23), a pressure-medium actuated reversing valve (19) connected to the actuating drive (3, 9) and movable toward an actuating position, spring means (33) for moving the reversing valve toward the actuating position in conjunction with pressure obtaining at the tensioning drive (3, 6), said reversing valve being movable away from an actuating position by the pressure present in front of the restrictor (24) in the pressure-medium supply line (23).

2. The tool according to claim 1 including means for measuring the tensioning pressure and for indicating the band tension which is thereby obtained.

* * * * *